US005165880A

United States Patent [19]

White

[11] Patent Number: 5,165,880

[45] Date of Patent: Nov. 24, 1992

[54] GEROTOR DEVICE WITH BIASED ORBITING VALVE AND DRAIN CONNECTION THROUGH WOBBLESTICK

[75] Inventor: Hollis N. White, Hopkinsville, Ky.

[73] Assignee: White Hydraulics, Inc., Hopkinsville, Ky.

[21] Appl. No.: 724,903

[22] Filed: Jul. 2, 1991

Related U.S. Application Data

[63] Continuation-in-part of Ser. No. 580,072, Sep. 10, 1990, Pat. No. 5,135,369.

[51] Int. Cl.[5] ..... F01C 1/10; F03C 2/08

[52] U.S. Cl. ..... 418/61.3

[58] Field of Search ..... 418/61.3, 102; 251/175, 251/176; 137/312, 625.2

[56] References Cited

U.S. PATENT DOCUMENTS

| | | | |
|---|---|---|---|
| 2,671,410 | 3/1954 | Wahlmark | 418/102 |
| 2,984,223 | 5/1961 | Budzich | 251/175 |
| 2,993,450 | 7/1961 | Welgert | 418/102 |
| 3,289,601 | 12/1966 | Compton | 418/61.3 |
| 3,572,983 | 3/1971 | McDermott | 418/61.3 |
| 3,964,842 | 6/1976 | White, Jr. | 418/61.3 |
| 4,035,113 | 7/1977 | McDermott | 418/61.3 |
| 4,171,938 | 10/1979 | Pahl | 418/61.3 |
| 4,298,318 | 11/1981 | Tsuchiya et al. | 418/61.3 |
| 4,411,606 | 10/1983 | Miller | 418/61.3 |
| 4,480,971 | 11/1984 | Swedberg | 418/61.3 |
| 4,877,383 | 10/1989 | White, Jr. | 418/61.3 |
| 4,976,594 | 12/1990 | Bernstrom | 418/61.3 |
| 5,100,310 | 3/1992 | Uppal | 418/61.3 |

*Primary Examiner*—John J. Vrablik

*Attorney, Agent, or Firm*—Woodling, Krost & Rust

[57] ABSTRACT

A spring loaded biasing cylinder on one side of an orbiting valve is utilized to seal the orbiting valve to the manifold structure on the opposing side of the valve to eliminate the necessity for physical seals therebetween. The center drive opening of the orbiting valve is expanded such that the center drive opening sweeps the longitudinal axis of as porting plate with a separate fluid connection through the porting plate allowing drainage of the central cavity of the gerotor device. A hole extending along the longitudinal axis of the wobble stick interconnects the central drive opening of the orbiting valve with such central cavity.

13 Claims, 9 Drawing Sheets

GEROTOR DEVICE WITH BIASED ORBITING VALVE AND DRAIN CONNECTION THROUGH WOBBLESTICK

This application is a continuation-in-part of prior U.S. Application Ser. No. 07/580,072 filed Sept. 10, 1990, U.S. Pat. No. 5,135,369.

FIELD OF THE INVENTION

This invention relates to a closed center hydraulic pressure device.

BACKGROUND OF THE INVENTION

Historically, hydraulic pressure devices have pressurized the entire internal cavity of the pressure device. This necessitates the use of high pressure seals throughout the device including surrounding the input/output shaft. In addition, it subjects the hydraulic fluid to contamination based on the physical contaminants produced by the wear between the input/output shaft to the power mechanism such as to and from the wobble stick in a gerotor device. U.S. Pat. Nos. 3,606,601 and 4,697,997 are examples of typical gerotor hydraulic motors. These gerotor hydraulic motors are serviceable. The motors do, however, both use a pressurized center. Closed center gerotor motors have many advantages, a number of which are described in Hollis White's seminal U.S. Pat. No. 4,877,383 (Device Having A Sealed Control Opening And An Orbiting Valve). U.S. Pat. No. 4,877,383 issued Oct. 31, 1989 provides a solution to the pressurized fluid problem by effectively isolating the center of the gerotor device from the operative fluid to and from the fluid power mechanism. The device of U.S. Pat. No. 4,877,383 does, however, show in its preferred embodiment the use of seals on the inside of the orbiting valve in order to seal the connection to the wobble stick drive. These seals necessitate a somewhat larger inner section for the valve than would be otherwise possible. The seals also serve to restrict the size of the wobble stick drive interconnection to the orbiting valve. In addition, the drain for the center of the hydraulic device is via a separate drain line located outside of the gerotor structure. These provide limits for the application of the preferred embodiment of U.S. Pat. No. 4,877,383.

This present invention is directed to an improvement to the closed center type devices wherein the seal for the central drive opening of the commutator valve is provided through the use of a moveable piston. This seals the opening while also providing additional advantages including the ability to centralize and simplify the case drain for the device.

SUMMARY OF THE INVENTION

It is an object of this invention to provide for a closed center hydraulic device omitting inner seals.

It is an object of this invention to increase the size of the interconnection between the wobble stick and orbiting valve in a gerotor device.

It is an object of this invention to provide for a central case drain for a hydraulic motor.

It is an object of this invention to reduce the cost of gerotor devices.

Other objects and a more complete understanding of the invention may be had by referring to the following description and drawings in which:

DESCRIPTION OF THE PREFERRED EMBODIMENT

This invention relates to an improved closed center gerotor device. This application is a continuation in part of U.S. Ser. No. 07/580,072 filed Sept. 10, 1990. A basic description of a closed center device is to be found in Hollis White's U.S. Pat. No. 4,877,383 (Device Having A Sealed Control Opening And An Orbiting Valve). The preferred embodiment of U.S. Pat. No. 4,877,383 uses separate "O" ring seals for a valve 14 in addition to a pin interconnection between the wobble stick 15 and valve 14. This design is serviceable. It is also reasonably complex with the specific diameters and locations of various parts restricted by the presence of the "O" ring seals.

Figure 1:
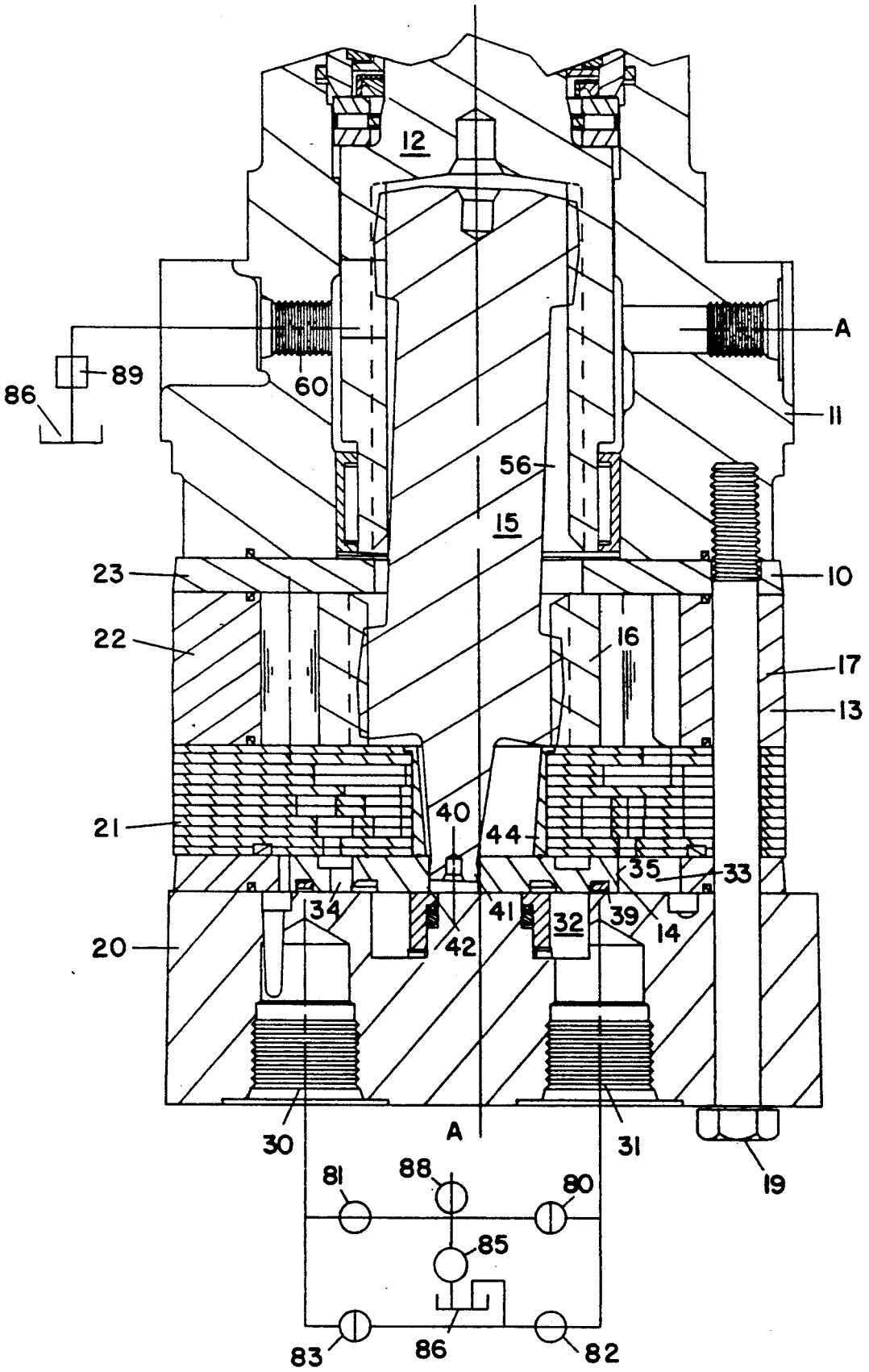
FIG. 1 is a central longitudinal cross sectional view of a gerotor structure incorporating the invention.

This invention relates to an improved gerotor device using a piston to provide for the closed center seal. This piston improves the sealing between the moving valve and the stationary device. The piston also allows for usage of an integral toe wobble stick. The invention will be described in the preferred environment of a gerotor motor/pump 10 a having a housing 11 containing a drive shaft 12 connected to a gerotor structure 13 and rotary valve 14 via a wobble stick 15 (FIG. 1). The gerotor device 10 can produce power when fluidically connected as a motor to a source of high pressure or it can produce high pressure fluid when physically connected as a pump to a source of unpressurized fluid. The device is described as a motor.

The drive shaft 12 is located in the housing 11 for rotation in respect thereto. In a gerotor motor, such as that disclosed in Mr. White's prior patent U.S. Pat. No. 3,606,601, the speed and direction of rotation of this shaft 12 is governed by the volume, pressure and direction of flow of the fluid through the gerotor structure 13. In the embodiment shown in the present application the fluid flow through the device is controlled by four valves 80, 81, 82 and 83. These valves 80–83 are selectively operated to connect a port 30, 31 to a fluid pump 85 (source of pressurized fluid) and to connect the other port 30, 31 to the sump 86 (discharge of fluid) from which the pump 85 draws fluid. In the embodiment shown an auxiliary port A can be also selectively connected via valve 88 to the fluid pump 85 to lubricate and cool the bearings of the device if needed. A filter 89 filters this lubrication loop fluid before discharge to the sump 86, thus effectively isolating the lubrication function from the power function of the device. The center of the device is isolated by the closed center seal. For this reason, a totally separate fluid loop can be utilized to circulate fluid through the center of the device, a mere drain can be utilized to drain off any incidental fluid that enters the center of the device, no fluid connections could be utilized allowing fluid to self circulate in the center of the device, a single ended chattering ball pump as disclosed by U.S. Pat. No. 4,940,401 could be used off of an occasionally pressurized area to circulate fluid from the center of the device to the occasionally pressurized area, or other fluid handling means could be utilized with such isolated center.

The shape of the housing 11 of this current motor/-pump 10 is designed to match the intended application, even to the extent of being integral thereto (a feature allowed by the isolation of fluid within the gerotor structure 13 as will be later described).

The gerotor structure 13 is removably attached to the housing 11, preferably by bolts 19. The gerotor structure 13 include an end plate 20, a manifold plate 21, a gerotor device 22 and a balancing plate 23 fixedly attached together by bolts (not shown) so as to produce a single integral unit. The gerotor device shown is an orbiting rotor 16 within a stationary stator 17. Other pressure mechanisms could also be used as the power generating means for the device.

The end plate 20 is the termination cap and porting plate for the device 10. The plate 20 can be of single (FIGS. 1-3) or multiplate (FIG. 4) design. Two ports 30, 31 are formed into the plate 20 so as to form the fluid connections for the device. One port 31 connects to a commutation ring or passage 32 in the opposing face of the plate 20. This commutation ring or passage 32 in turn communicates with the central section 34 of the orbiting valve 14 to provide a fluid connection therefor. The other port 30 connects to a ring-shaped cavity 33 on the opposing side of the plate 20. This cavity 33 surrounds the outside circumferential edge 35 of the orbiting valve 14 to provide a second fluid connection to the valve 14.

The orbiting valve 14 is the main valve for the device 10. The particular embodiment of FIG. 1-3 utilizes a conventional ring shaped valve having a circular center opening 34 and a surrounding circular edge 35. The center opening 34 of the valve 14 communicates with one port 31 via the ring or passage 32. The external side about outer edge 35 of the valve 14 communicates with the other port 30. (Due to the fact that there is a space between the outermost surface of the orbiting valve 14, fluid is able to freely move about the outside of the valve 14). The embodiment of FIG. 4 uses an orbiting movement of a modified valve 14 as the main valve for the device. In contrast with FIGS. 1-3, the orbiting valve 14 is connected to the wobble stick 15 for rotation therewith and there are discreet openings for the center opening 34 and indented scallops in the outer edge 35. This allows the overall device to be smaller than in a circular valve device. A more detailed discussion of this valve 14 is found in Mr. White's presently pending application 07/471,475 filed Jan. 29, 1990 for a Reduced Sized Hydraulic Motor. In both embodiments the valve 14 is an orbiting valve that selectively interconnects fluid of two ports to expanding and contracting gerotor cells through bi-directional fluid passages in the stationary body of the housing of the device. This is preferred.

The manifold plate 21 is on the opposing side of the orbiting valve 14 from the end plate 20 between the valve 14 and rotor 16. The manifold plate 21 serves to connect the center 34 and outer 35 sections of the orbiting valve 14 to the gerotor cells between the rotor 16 and stator 17 selectively as the device is operated. The manifold plate 21 itself is formed as a brazed assembly of thin stamped plates as taught in Mr. White's U.S. Pat. No. 4,697,997.

Pressurized fluid is not introduced into the central wobble stick drive opening of the manifold 21 unless desired (for example, a separate bearing lubrication loop). The pressurized fluid is instead segregated to the area of the device near the orbiting valve 14 by the sealing of the wobble stick drive connection to the valve 14. This sealing is accomplished by restricting the effective size of the drive opening through the manifold plate 21 to an area capable of being sealed by the inside drive surface of the valve 14. To accomplish this the radius of the drive surface of the valve 14 is slightly greater than the radius of the opening in the manifold 21 plus the offset of the center of the valve 14 from the center of the valve manifold 21. With this relationship the inside drive surface of the valve 14 will seal the opening throughout the operational valving orbit of the valve 14. This relationship is taught in the preferred embodiment of U.S. Pat. No. 4,877,383. Any fluid that does leak through the seal into the central wobble stick cavity is easily drained off: The fluid would be of very low volume and would be unpressurized. An internal drain connection is provided for this fluid.

The present invention provides a seal for the valve with a biasing piston, thus also isolating the high pressure to near the valve in a manner to prevent most leakage within the device.

Due to the confinement of the high pressure to the area near the valve 14, the invention of this application allows one to treat the gerotor structure 13 as a self-contained unit. The associated mechanical structure (like housing 11) need not have high pressure seals or other fluid containment means. The gerotor structure unit can be bolted onto a housing 11 or otherwise integrated into mechanical structures with little regard for the existence of the high pressure fluid within the gerotor structure 13. This fluid isolation allows the functions of the drive shaft 12 and housing 11 to be incorporated into the mechanical structures without the need for incorporating high pressure seals in such mechanical structures, significantly shortening the effective longitudinal length of the device. The fluid isolation also allows one to remove the gerotor structure 13 from its associated mechanical structure without regard for the fluid in the gerotor structure. Both the gerotor and mechanical structure can thus be easily interconnected, separated and repaired without regard for the other. Other advantages also flow from the isolation of fluid within the gerotor structure 13.

Due to the use of the biasing piston on the side of the valve 14, the mechanical sealing on the other side of the valve 14 is improved. In the preferred embodiment disclosed this includes the sealing over the bi-directional valving openings in the manifold 21. This improves the efficiency of the device.

The plate 23 is a thin plate trapped between the housing 11 and gerotor 22. The plate 23 generally seals the gerotor structure 13 against fluid leakage. If desired a small pocket can be incorporated behind it in the housing 11 which pocket is connected to a high pressure feed. This could be accomplished for example by including holes running axially through the rotor terminating at each face of the rotor. Other holes in the manifold plate 21 and plate 23 would be located within the confines of the area continually swept by the holes in the rotor. The holes in the rotor would sweep the holes in the manifold plate that are pressurized by high pressure, with the hole in the rotor in turn sweeping the holes in the plate 23 to pressurize the pocket in the housing 11. The pressure of fluid in the pocket in the housing would in turn force the plate 23 back towards the rotor pressure balancing same. If the device is designed for bi-directional rotation, small check valves could be utilized to insure the appropriate high pressure only connection. The size of the pocket in the housing 11 would be designed to match the rotor's axial imbalance for the incoming high pressure. The balancing plate is described in detail in the U.S. Pat. No. Application 798,301 filed Nov. 15, 1985 by Mr. White issued as U.S. Pat. No. 4,717,320 on Jan. 5, 1988.

Figure 2:
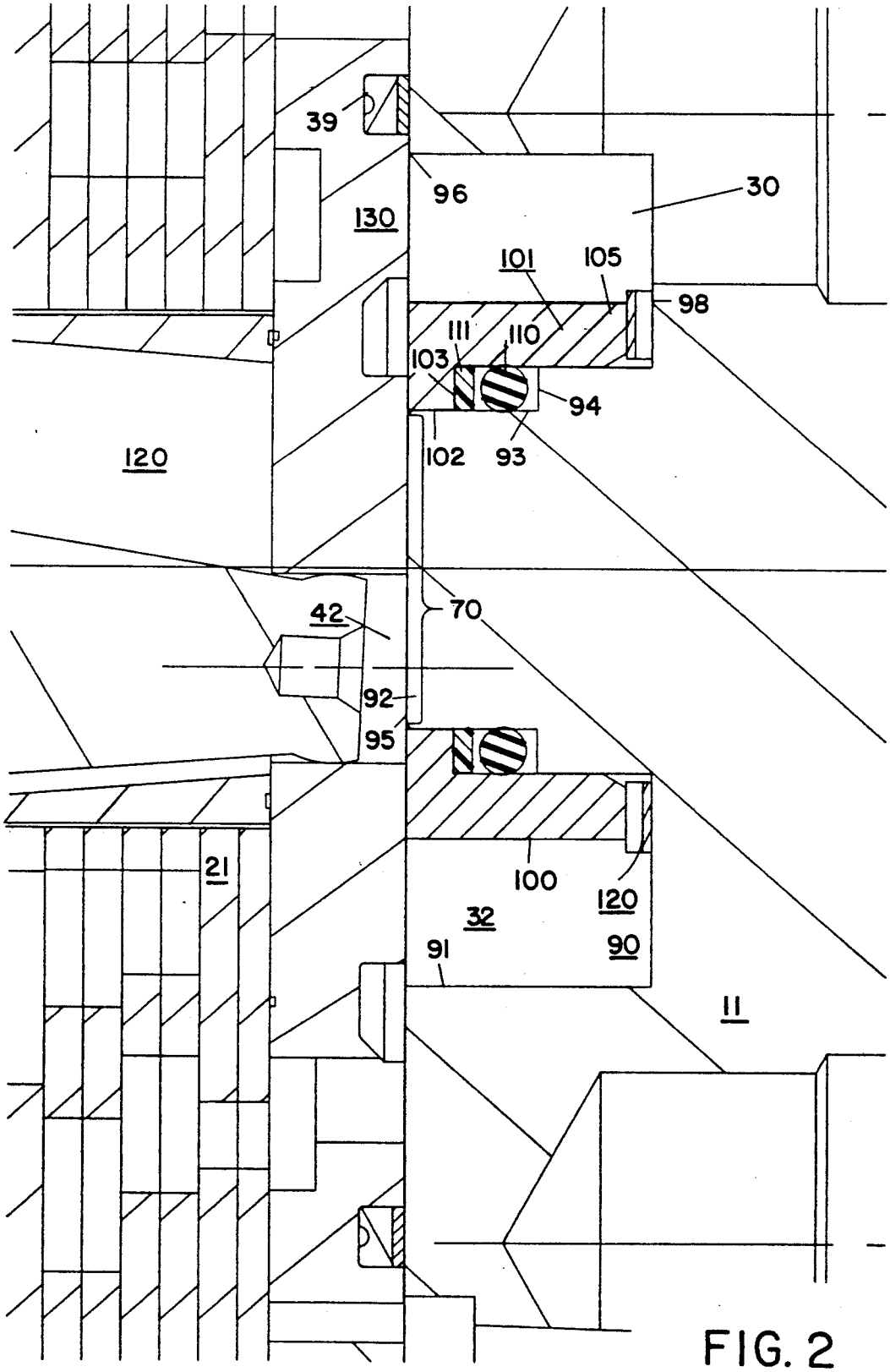
FIG. 2 is an enlarged view of the sealing area for the gerotor device shown in FIG. 1.
Figure 3:
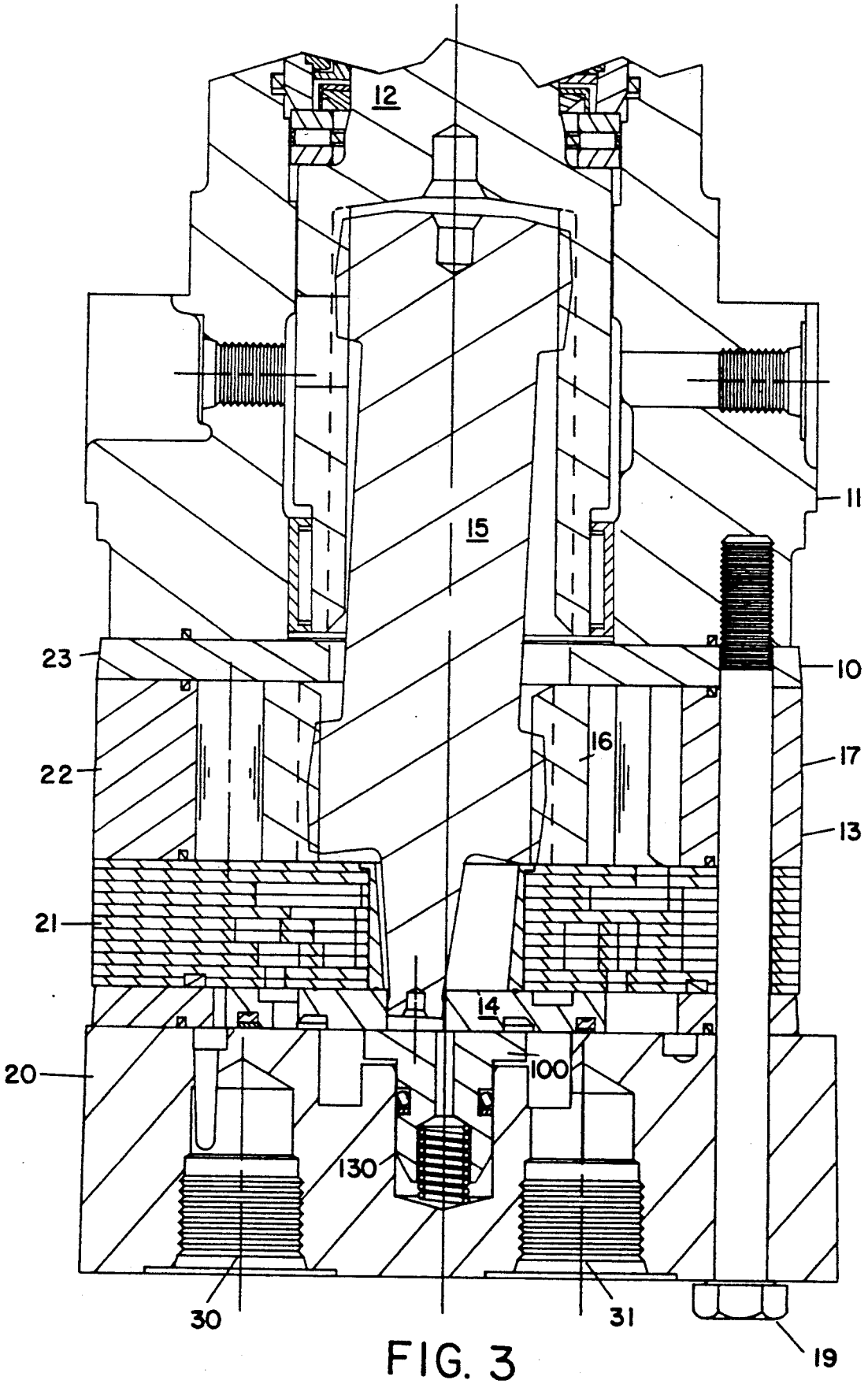
FIG. 3 is a view like FIG. 2 of a modified sealing structure.
Figure 4:
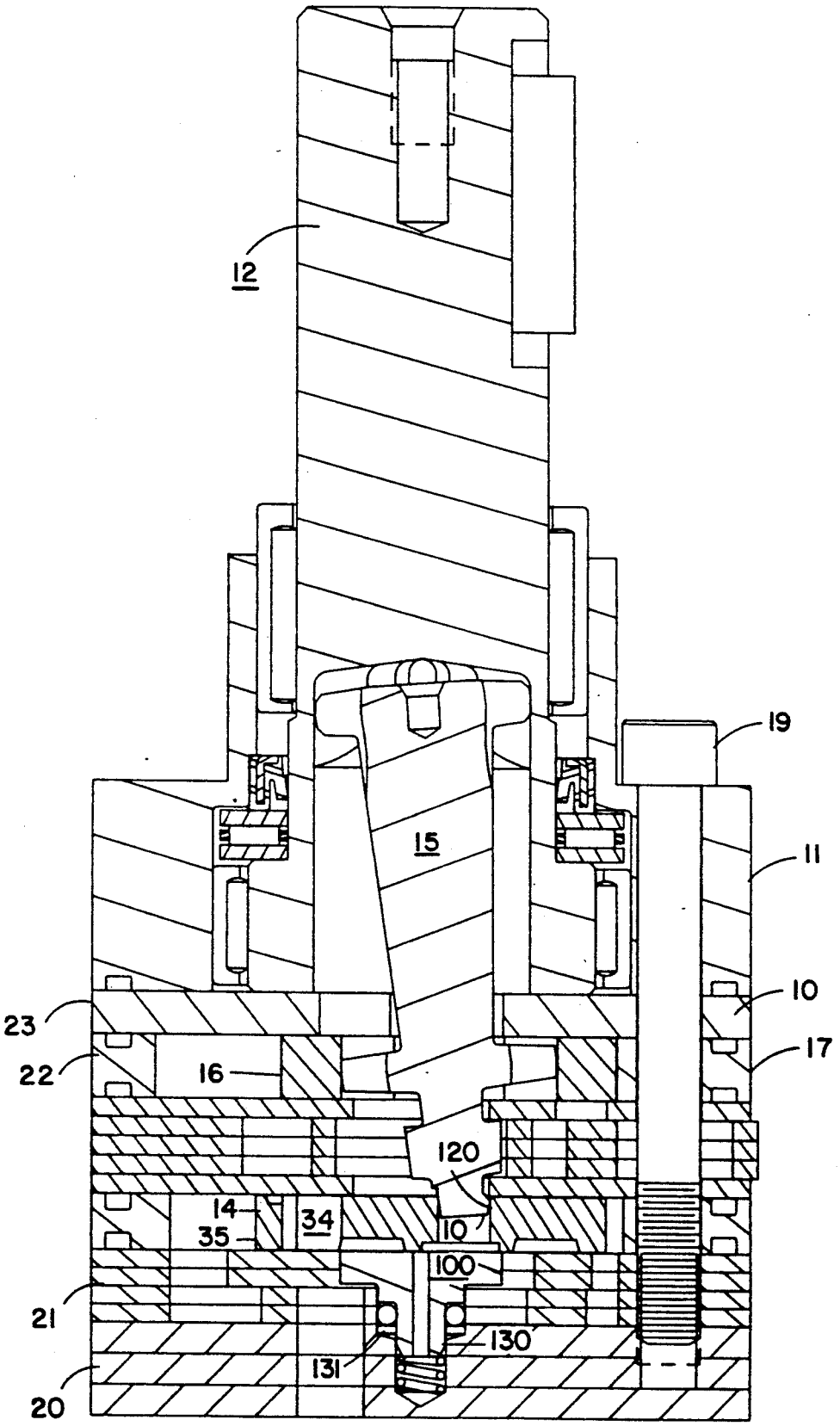
FIG. 4 is a variation of the modified sealing structure.
Figure 5:
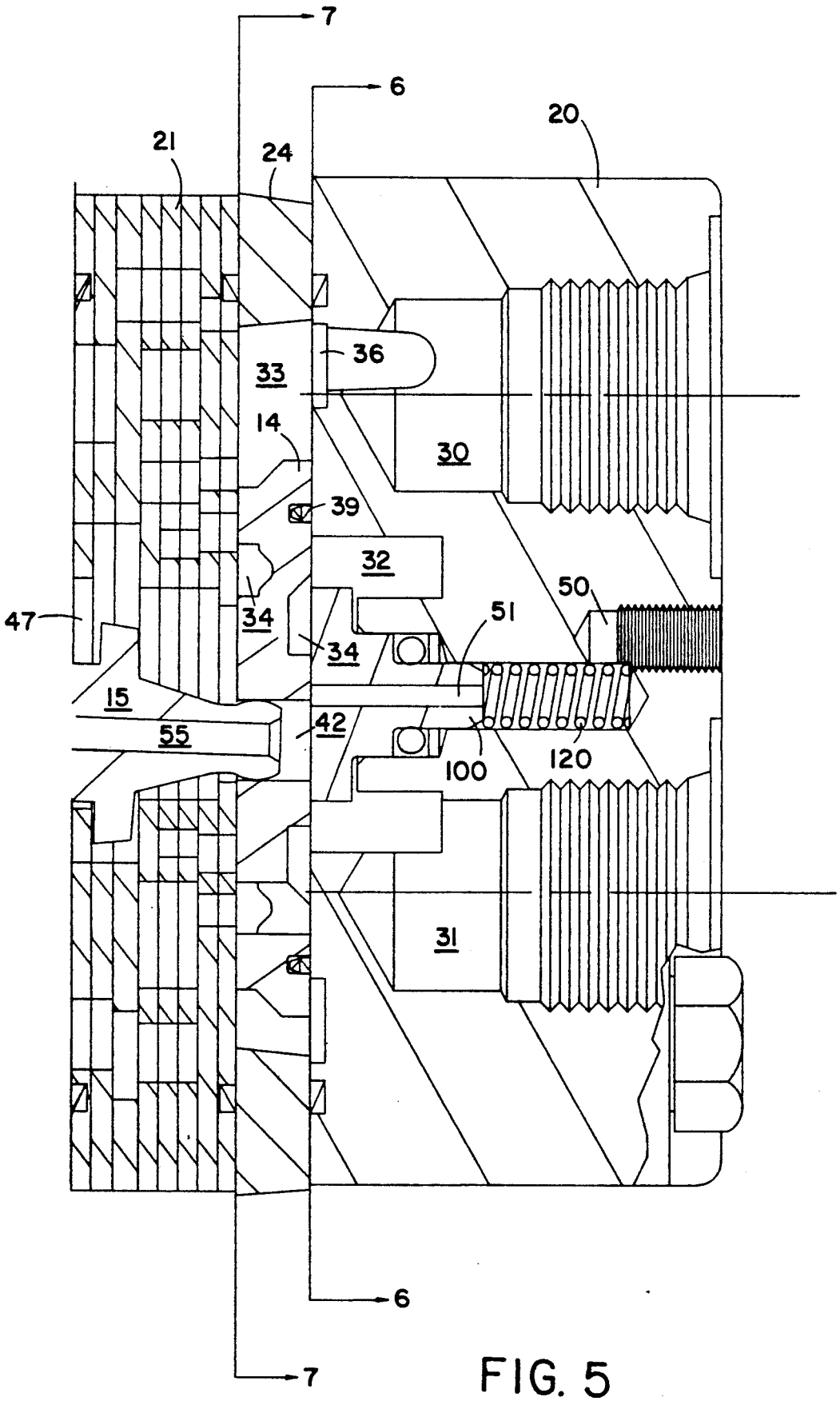
FIG. 5 is a partial longitudinal cross sectional view of a hydraulic pressure device incorporating the invention of the application.
Figure 6:
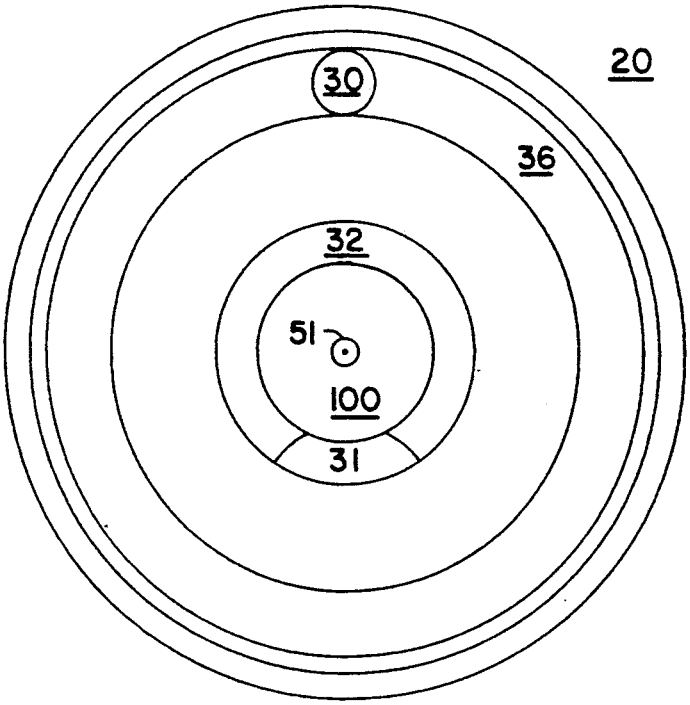
FIG. 6 is a lateral cross sectional view of the end-/porting plate of FIG. 5 taken generally along lines 6—6 in that FIG.
Figure 7:
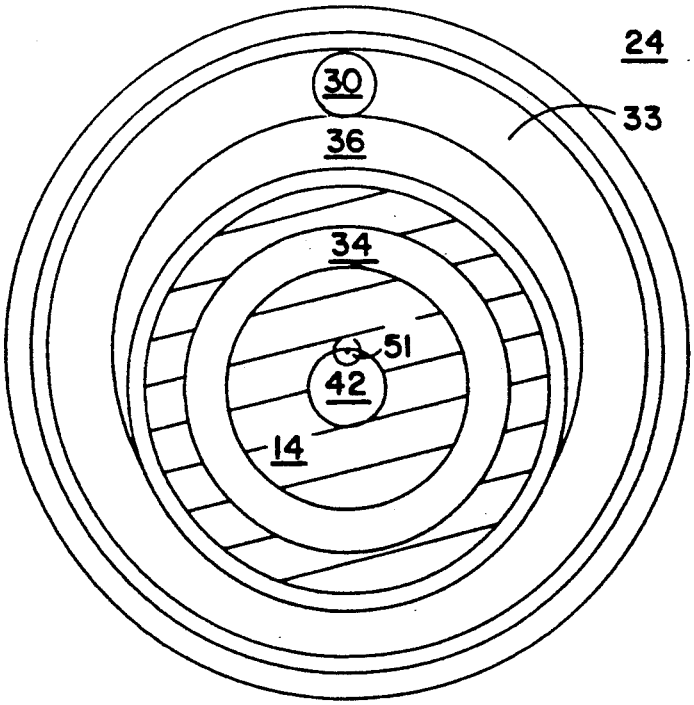
FIG. 7 is a lateral cross sectional view of the orbiting valve of the device of FIG. 5 taken generally along lines 7—7 in that figure.
Figure 8:
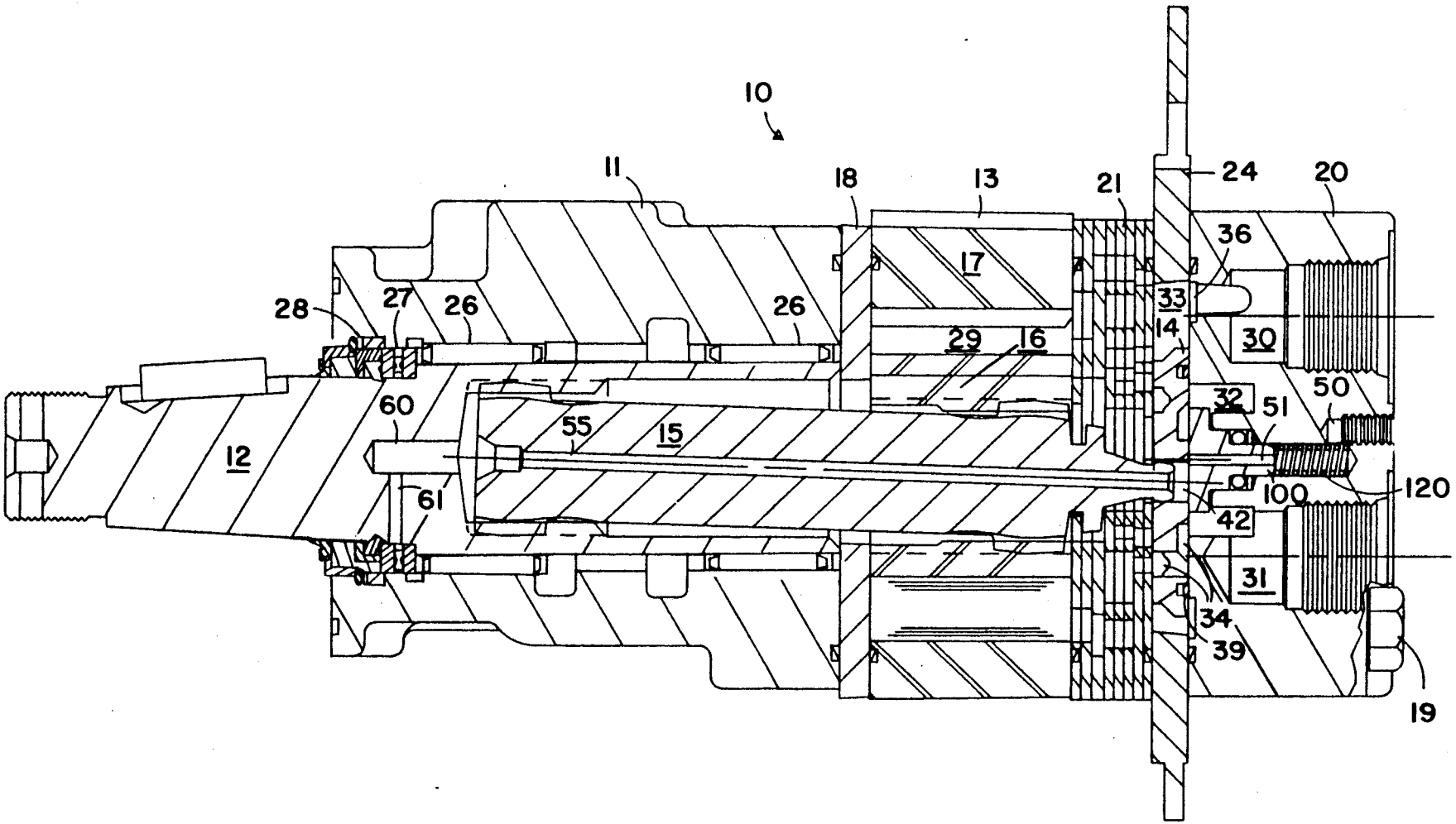
FIG. 8 is a lateral cross sectional view of an entire hydraulic device incorporating the partial sectional view of FIG. 5; and, FIG. 9 is a lateral cross sectional view of an alternate embodiment of the invention.

The wobble stick 15 connects the drive shaft 12 to both the rotor 16 and valve 14. In the preferred embodiment disclosed an integral extension or toe 40 extends off of the end of the wobble stick 15 to interconnect with the orbiting valve 14. In the embodiments of FIGS. 1–3, a semi-circular cross section tip 41 of such toe 40 extends into a circular opening 42 in the valve 14 with substantially no radial clearance therebetween. This provides for accurate valve timing. The interconnection of the wobble stick 15 to the orbiting valve 14 in the embodiment of FIG. 4 is similar with the addition of an indexing means (splines 120 shown) so as to connect the valve 14 to the wobble stick 15 for rotation therewith. The sides of the toe 40 are designed to provide for the maximum cross sectional area along the full length of the toe 40. This strengthens the toe 40. It is preferred that the toe 40 have a slight taper or clearance along its length so as to allow for more than a token overlap between the face of the valve 14 inside of the central opening 34 and the inside surface of the manifold 21. This in combination with the longitudinally extending cap 44 on the inside surface of the manifold 21 provides for a good mechanical seal at this critical juncture. The cap 44 and valve 14 are preferably both of substantially equal hardness, in the embodiment shown-RC-60 steel.

In its orbiting motion the valve 14 connects the port 31 through the central opening 34 to some gerotor cells of the gerotor device 22 while connecting the port 30 through the surrounding edge 35 to others of gerotor cells of the gerotor device 22 through the manifold plate 21 as is customary for separate orbiting valve devices. In a major point of departure, however, fluid is generally isolated totally within the gerotor structure 13; neither the central opening of the rotor 16 nor the central opening 56 of the housing 11 are connected to any source of fluid. Any residue fluid that does manage to get into the openings or otherwise into this section of the device is easily drained off via a small passage 60 leading off of the openings to an external sump (as 86).

Due to the fluid isolation, the gerotor structure 13 forms a separate, totally integral device. This device can be attached and separated at any time without any concern for the condition of the fluid pressure fed to the ports 30, 31. The device can also be utilized with housings 11 not designed or otherwise supplied with high pressure seals. This isolation allows one to utilize gerotor structures in a greater variety of devices.

In this present invention the seals that allow this isolation for the valve 14 are provided by a spring biased piston 100 in a cavity 90 of the housing 11 (FIGS. 2, 3).

The piston 100 is utilized to bias or force a mechanical flat seal between the housing 11 (specifically the end plate 20 and manifold 21), and the valve 14 so as to seal the wobble stick toe drive area from fluid. In the preferred embodiment the piston 100 is a generally cylindrical shaped member 101. It is preferred that the piston 100 be manufactured of machinable steel having a hardness lower than that of the valve 14. This concentrates wear on the replaceable piston 100. Note that it is also preferred that the hardness of the piston 100 be such as to allow one to turn the cylindrical form of the piston 100 without the necessity for later heat treatment. In the embodiment disclosed the hardness of the piston 100 is approximately RC-37.

The piston 100 cooperates with the cavity 90 to create the bias or force for the mechanical flat seal. The cavity 90 is formed in the housing 11 of the gerotor motor 10, preferably in the end plate 20 on the opposite side of the valve 14 from the manifold 21. This allows a single piston to create seals on two surfaces of the valve 14. The cavity 90 itself a cylindrical opening 91 generally matching the shape of the piston 100.

It is preferred that the outer diameter of the cavity 90 near to the valve 14 is sufficiently greater than the outer diameter of the cylinder 100 so as to form a fluid ring or passage 32 therebetween. This creates this fluid passage 32 without the need for a separate manufacturing operation on the end plate 20. It also locates such passage as inwardly as possible. The passage 32 in turn is connected to one 31 of the two fluid ports for commutation as previously described.

The piston 100 of the preferred embodiment of FIGS. 1 and 2 has a two diameter hole 102 extending axially through the piston 100 for use with a central locating section 92 (later described) extending off of the end plate 20. A small step 103 is located between the two diameters of the hole 102. This small step 103 reduces the effective diameter of the piston 100 that is subjected to pressure (as later described). This reduction lowers the operational forces between the piston 100, valve 14 and manifold 21 to preferable sealing levels (i.e., levels to provide the mechanical seals without causing undue wear).

The cavity 90 that is utilized with this preferred embodiment includes a central locating section 92 (contrast FIG. 2 with FIGS. 3 or 4). The locating section 92 has two diameters 93 separated again by a small step 94. The diameters of the locating section 92 are generally selected to match the diameters of the hole 102 of the piston 100 radially support such piston 100 while also allowing the piston 100 to slide axially on the locating section 92. It is preferred that the end 95 of the locating section 92 be slightly recessed in respect to the plane of the valve 14 so as to avoid any interference with the valve 14 (as later described). In this respect note that the piston 100 could extend over the end of the locating section 92 if desired so as to present a uniform surface to the valve 14. This would spread out the load over a greater surface area, albeit at a cost of increased friction.

The gap between the piston 100 and cavity 90 is sealed so as to create the operative forces for the piston 100. In the embodiments shown in FIGS. 1 and 2, an "O" ring seal 110 is included between the step 94 of the locating section 92 and the step 103 of the piston 100. It is preferred that this seal 110 include a teflon backup 111 on the side opposite to the "O" ring from any high pressure interconnection (in this case the fluid passage 32 alone). This "0 " ring seal 110 prevents any fluid from the passage 32 leaking between the locating section 92 and the piston 100 so as to interconnect through the end 41 of the locating section 92 to the center of the housing 11. This "O" ring seal 110 therefore accomplishes the purpose similar to that of the seal 38B in U.S. Pat. No. 4,877,383 as above described.

If no locating section 92 is included in the cavity 90, another guidance means should be provided for the piston 100. One guidance means is to have the outer diameter of the piston 100 contact the cavity 90 for at least part of its length (FIGS. 3 and 4). By reducing this section 130 of contact, again the biasing forces can be retained at preferable sealing levels. This reduced section 130 has substantially the same diameter as a part of the piston 100. The reduced section 130 can thus provide the same physical localization and guidance for the piston 100 as the locating section 92, albeit externally instead of internally. Again a step 131 is preferably included so as to reduce the area available for the cylinder effect. In the embodiments of FIGS. 3 and 4, a seal 110 is provided on the outer surface of the piston 100 to create the operative forces (again with teflon backup 111 if appropriate).

Note that in all embodiments, it is preferred that the piston 100 have a sufficient overlap with a flat surface of the valve 14 so as to provide for a mechanical flat seal without undue wear (caused primarily by a concentration of forces on too small an area). In general the lower the sealing force of the piston, the greater this area of contact must be. Preferably the force over the seal is approximately 100 PSI.

A spring is preferably included in the device so as to provide an initial bias for the piston. A wave spring 120 is included between the end 105 of the piston 100 and the back wall 98 of the cavity 90 in FIGS. 1 and 2. This wave spring 120 provides a bias for the piston 100 against the valve 14. This is useful on start up and shut down. A coil spring 125 is provided in FIGS. 3 and 4 for a similar purpose. In the preferred embodiment disclosed, this initial loading of the spring is substantially ten pounds. Upon pressurization of the device, the piston 100 will be forced outwards of the cavity 90 due to the pressure loading of the piston 100. In this pressure loading the surface area of the step 103 or 131 would be multiplied by the pressure of the fluid in the passage 32 so as to provide the operative sealing force for the piston 100 away from the back wall 98 of the cavity 90. Again it is preferred that this force be about 100 PSI.

The pressure of the piston 100 forces the piston 100 against one side of the valve 14. This seals the surface of contact between the piston 100 and the valve 14. Located on the other side of the valve 14 is a cap 44 on the inside of the multiplate manifold 21. This cap 44 extends about the circumference of the inner diameter of the manifold 21 and is brazed integrally thereto flush therewith. The outer diameter of this cap 44 is equivalent to the inner diameter of the manifold 21. The inner diameter of the cap 44 is of a shape and diameter sufficient to allow clearance for the movement of the wobble stick 15 during the operation of the device while also providing for an overlap of the surface of the valve 14 on the inside of the opening 34. Due to the force of the piston 100 on the other side of the valve 14, this overlap between the cap 44 and valve 14 is again a pressure loaded flat mechanical sealing contact. The piston 100 thus isolates the fluid in the valve 14 from the area within the cap 44 (and the center of the housing 11). Due to the location of the bi-directional valving holes on the surface of the same manifold 21 (surrounding the cap 44), this pressure loading also improves seals between adjoining valving openings against leakage at this critical area. This improves the fluidic efficiency of the device. Note that a separate seal 39 is preferably included for the area not pressure loaded by the piston 100. This seal 39 slightly increases the efficiency of the device by sealing between the two valving openings 33, 34 of the valve 14. This seal 39 does not pass over any openings. A separate seal 39 can therefore be utilized. As the outer edge of the valve 14 is not subject to the same dimensional, wear or other restrictions as the center of the valve, this use is acceptable.

By utilizing the cylinder or piston 100 to bias the valve 14 into a solid sealing contact with the cap 44 of the manifold 21, the seal for the center of the housing 11 can be provided in a smaller area than before. With a piston 100 providing the sealing, it is possible for the circular opening 42 and valving opening 34 of the valve 14 to sweep the same area without compromising the sealing. This allows optimization of the device sizing. The piston 100 also allows one to increase the size of the drive (the toe 40) that interconnects the wobble stick 15 and valve 14, strengthening this critical interconnection. This increase in size also allows for the incorporation of a case drain through the orbiting valve (as later described). The piston 100, by allowing one to eliminate the "O" ring or other separate seals for the center of the housing 11, simplifies the manufacture, repair and operation of the device. The use of a piston 100 also allows one to improve the sealing of an area that sweeps over holes or protuberances without concern for the longevity of the seal. This, for example, allows one to improve the sealing of the device at the bi-directional valving holes swept by the valve 14. This improves the overall efficiency of the device without longevity compromises.

FIGS. 5 through 8 disclose an alternate embodiment of the invention wherein the central opening of the orbiting valve is utilized as part of the case drain for the gerotor device. This allows the case drain port to be included in the end plate of the device.

The gerotor device 10 of FIGS. 5 through 8 has a body including a housing 11, a closure plate 18, a gerotor structure 13, a manifold plate 21, a valve clearance/-mounting bracket 24, and an end plate 20. These members are bolted together by bolts 19. Movably contained within the housing is a drive shaft 12, a wobble stick 15, a rotor 16, and a rotary valve 14.

The housing 11 of the body 10 of the gerotor device serves as the support member for the rotary drive shaft 12. The drive shaft 12 is radially supported to the housing 11 by the longitudinally placed radial bearings 26. A separate thrust bearing 27 transfers any outward motion on the drive shaft 12 to the housing 11 of the gerotor device 10. A main seal 28 seals the interior of the housing 11 from the outside world. Due to the incorporation of the invention of this particular application, the main seal 28 is normally not subjected to the full hydraulic pressure utilized with the gerotor device 10. For this reason, the requirements for this main seal 28 are significantly reduced from that otherwise necessary.

The closure plate 18, the gerotor structure 13, and the manifold plate 21 together define the pressure mechanism for the preferred embodiment of the application. This pressure device is a stationary stator 17/orbiting rotor 16 gerotor mechanism. The stationary stator 17 and rotor 16 together define expanding and contracting gerotor cells 29 therebetween in the normal manner. The closure plate 18 isolates these expanding and contracting gerotor cells 29 on one side of the gerotor structure 13. The manifold plate 21 on the other side of the gerotor structure accomplishes the same purpose as the closure plate 18. In addition, this manifold plate 21 interconnects the fluid in the rotary valve 14 (later described) with the expanding and contracting gerotor cells 29. Examples of the construction of the multiplate manifold are set forth in U.S. Pat. Nos. 4,697,997—Gerotor Motor and U.S. Pat. No. 4,877,383—Device Having a Sealed Control Opening and an Orbiting Valve. Other pressure mechanisms and manifolds could be utilized with the invention if desired.

The valve clearance/mounting bracket 24 serves in the particular embodiment to provide a spacer for the rotary valve 14 between the manifold plate 21 and the end plate 20 (later described). In addition, this bracket 24 serves to mechanically interconnect the body of the gerotor device to the physical structure with which such gerotor device 10 is to be utilized. The valve clearance section could be integral with either the manifold plate 21 or end plate 20 and other mounting mechanisms could also be used for the body of the gerotor device if appropriate.

The end plate 20 serves to complete the body of the gerotor device 10. The end plate 20 also serves to fluidically interconnect the gerotor device 10 to the outside world. This is accomplished through the use of two main operating ports 30, 31 and a secondary drain port 50. The first port 30 is internally connected to the ring shaped cavity 33 surrounding the rotary valve 14. Thus, this provides one fluid connection for the gerotor device 10. Note that since this ring shaped cavity 33 extends for a 360° extent around the rotary valve 14, a simple hole connection would serve to interconnect the port 30 to this ring shaped cavity 33. In the preferred embodiment disclosed, a slight recessed ring 36 is provided in the end plate 20 so as to provide an additional measure of fluid connection. This recess 36 also serves to slightly lubricate the face surface of the rotary valve 14 during operation.

The second port 31 is interconnected to the center section 34 of the rotary valve 14 so as to pass fluid therebetween. A recessed commutation ring or passage 32 in the end plate 20 serves to increase the area for fluid interconnection between the center section 34 and the port 31.

A single seal 39 serves to separate the center section 34 of the valve 14 from the ring shaped cavity 33 about such valve 14. This seal 39 allows for a slight axial movement of the valve 14 (as well as compensating for thermal expansion et al) while maintaining a physical seal between the fluidic areas of the valve 14. The other surfaces between the valve 14 and the manifold plate 21 and between the valve 14 and the end plate 20 are physically sealed due to the piston 100 (as previously and later described). This use of a single seal 39 simplifies the device while increasing its service life. The seal 39 shown in the preferred embodiment is made of a metal ring biased against the end plate 20 by an integrally connected inner "O" ring.

The wobble stick 15 serves to mechanically interconnect the drive shaft 12 with the rotor 16 and the rotary valve 14. In a conventional gerotor device, this area surrounding the wobble stick 15 is subjected to the full high pressure utilized in the operation of the gerotor structure 13. This subjects the operating fluid to the physical contaminants produced by the wear in the mechanical interconnection between the input/output shaft and one end of the wobble stick and the mechanical connection between the rotor 16 and the other end of the wobble stick 15. These physical contaminants reduce the longevity of the motor. In a gerotor device such as that in U.S. Pat. No. 4,877,383, this problem is alleviated to a certain degree by the isolation of the operating fluid to the gerotor structure, manifold plate, and end plate. Any residual fluid which does leak into the central wobble stick cavity of this U.S. Pat. No. 4,877,383 power device is drained off in the preferred embodiment by a passage which extends outside of the gerotor structure to selectively interconnect to the ports via check valves. In the particular preferred embodiment disclosed in U.S. Pat. No. 4,877,383, a solid pin is utilized to interconnect the wobble stick to the orbiting valve, and an outer surface passage is utilized for the drain on the central wobble stick cavity. This is partially due to the dimensions of the various parts. In contrast, in the preferred embodiment of the present application, the drive to the rotary valve 14 is integral with the wobble stick 15 with the interconnection to the drain port 50 being accomplished through a hole 51 located along the longitudinal axis of the end plate 20. This on axis interconnection is allowed because the sealing between the orbiting valve and the manifold plate 21 is provided by the piston 100 instead of traditional seals. Due to this elimination of physical seals, it is possible for the center circular opening 42 of the rotary valve 14 to be expanded in size such that this center circular opening 42 sweeps an area at or in close proximity with the longitudinal central axis of the end plate 20. Due to the size of the circular opening 42, a hole 51 drilled in the area swept by the opening 42 on or near such axis is in constant communication with the center circular opening 42 of the rotary valve 14. This allows for a preferred constant communication of fluid therebetween, which constant communication allows for the central drain passage for the device (intermittent communication would also function, albeit not as well).

Figure 2A:
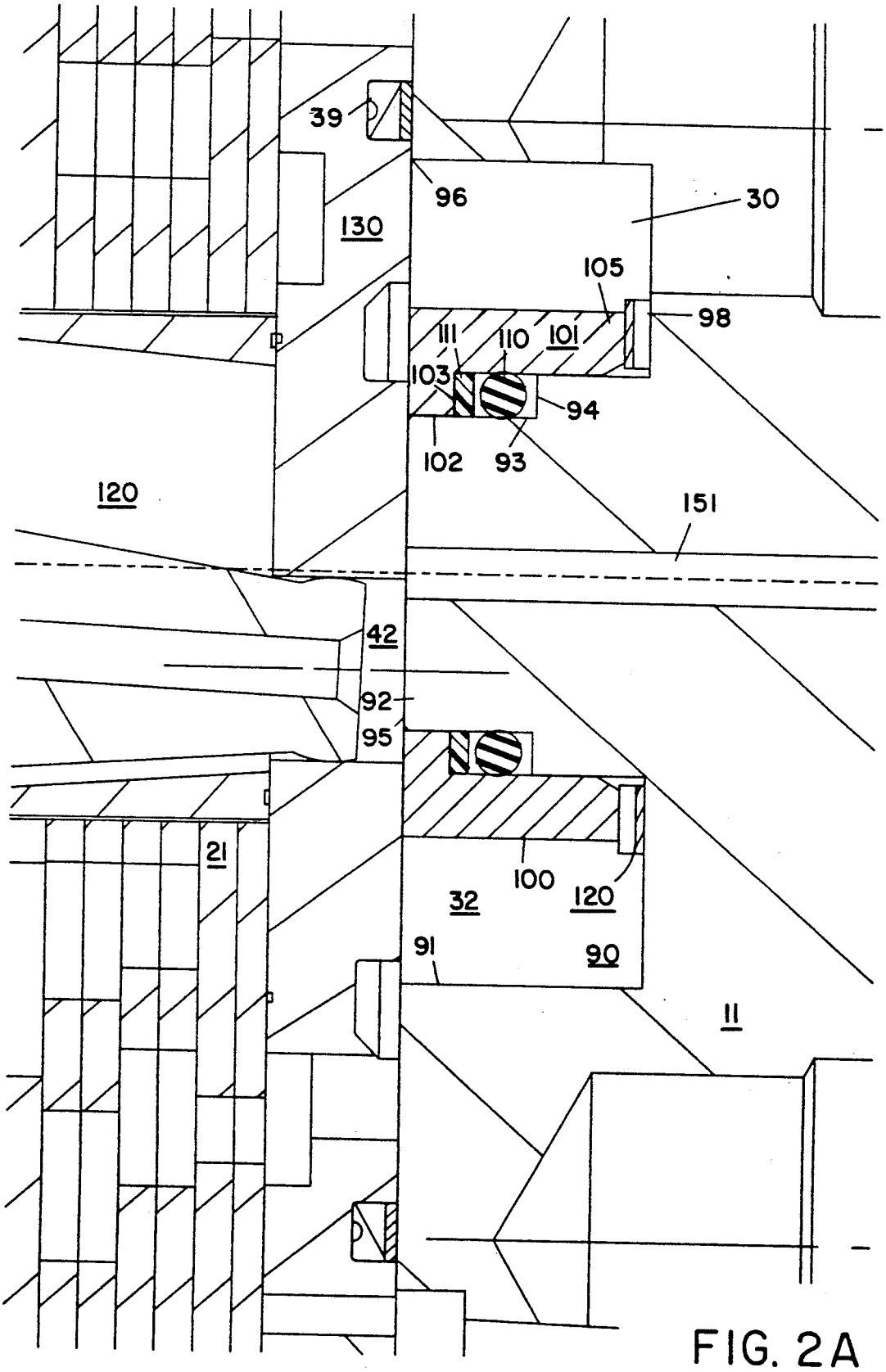
FIG. 2A is a view similar to FIG. 2 of an alternate embodiment of the invention.

In the preferred embodiment of FIGS. 5 through 8, a hole 151 is directly in the piston 100. The hole 51 could also be located within the housing as shown in FIG. 2A, for example in the area 70 of the end plate 20 within the ring shaped piston 100 of FIG. 2 that the circular opening 42 traverses during the operation of the gerotor motor/pump 10. Note that in this alternate embodiment, the piston 100 establishes a mechanical seal between the passage 32 and the area 70 in communication with the circular opening 42 of the valve 14. For this reason, there will be constant communication between the opening 42 and the area 70 even if the opening 42 does not physically overlap the longitudinal axis of the housing. Note further, that in this embodiment, the drain hole 151 can interconnect to the area 70 anywhere within the piston ring 100. This is because the entire area 70 effectively is the end of the drain hole 151 due to the fact that fluid exists and freely travels over the entire area 70.

In the preferred embodiment shown, the actual size of the opening 42 is preferably substantially equal to the diameter of the end of the wobble stick 15. This seals this connection sufficiently to encourage fluid passage down the center hole 55 in the wobble stick 15 (as well as providing for accurate valving). If desired, a separate seal could be incorporated at this location also. The effective radius of the circular opening 42 is substantially equal to or greater than the offset of the axis of the valve 14 and the longitudinal axis of the housing 11. This preferred minimum extension allows for constant communication between the opening 42 and the hole 51 on the longitudinal axis of the housing. (Note that locating the hole 51 anywhere on the surface swept by the circular opening 42 would also provide the required communication. This would provide the drain interconnection.)

The piston 100 in FIGS. 5–8 is forced into the rotary valve 14 by a large spring 120. This is allowed due to the fact that the piston 100 is itself pressure balanced (i.e., not subjected to a cylinder effect based on the pressurized main operating fluid for the device). Note that in the preferred embodiment disclosed the valve 14 is otherwise pressure balanced despite the fact that the center section 34 has differing diameters between the two sides thereof. This is true due to the similarity in surface areas for the center section 34 on the two sides of the valve 14. Differing diameters are utilized so as to optimize the placement of the seal 39 and maximize the sealing surface between the opening 34 and the hole 47 in the center of the manifold plate 21. If desired, differing surface areas could be utilized with a larger area on the side of the end/porting plate preferred as contributing to the spring loaded biasing effect of the piston 100. Alternately, the spring 120 can be replaced and/or supplemented by a hydraulic cylinder effect parasitic to the operating pressure for the gerotor device (as in FIGS. 1–4). This does, however, necessitate additional valving and/or fluid passages in the device, additional items that could compromise or complicate the design and/or manufacture of the central case drain of the embodiment of FIGS. 5–8. The spring force is, therefore, preferred.

In an alternate embodiment, the hole 51 in the piston 100 could be interconnected directly to either of the ports 30, 31 through ball check valves such that such hole 51 is interconnected to the port having the lowest pressure. This would eliminate the drain port 50 and provide for an integral drain, albeit at the cost of contaminating the main operating fluid of the device by the contaminants of the physical wobble stick drive connections. For this reason, ball check valves are not normally preferred.

The piston 100 allows for the mechanical connection between the wobble stick and the rotary valve 14 to be oversized in respect to the preferred embodiment of U.S. Pat. No. 4,877,383. This strengthens this mechanical interconnection while reducing the cost of providing for such interconnection (i.e., no separate pin is necessary). In addition, the oversized center opening 42 in combination with the hole 51 through the piston 100 allows for the circulation of the incidental fluid which does leak from the expanding or contracting gerotor cells through the center opening of the hydraulic gerotor device 10. This circulation is facilitated by the incorporation of a second hole 55 down the longitudinal length of the wobble stick 15. Due to this hole 55, the fluid which does leak from the expanding and contracting gerotor cells will be forced to the input/output shaft end of the wobble stick 15 to progress down the hole 55 to the hole 51 through the piston 100 and thus the drain port 50. This lubricates and cools the mechanical interconnection between the input/output shaft and the wobble stick 15 and otherwise. The hole 55 is preferably on the axis of the wobble stick 15. This facilitates manufacture. This also provides for a constant circulation of fluid to the head end of a thrust bearing 27 lubrication loop 61. As disclosed in U.S. Pat. No. 4,285,643, this lubrication loop 61 is accomplished by using the thrust bearing 21 as a pump from a radial hole 61 through the radial bearings 26 back to the central area of the gerotor device 10 next to the closure plate 18. This simultaneously cools and lubricates all of the critical bearings for the device.

Figure 9:
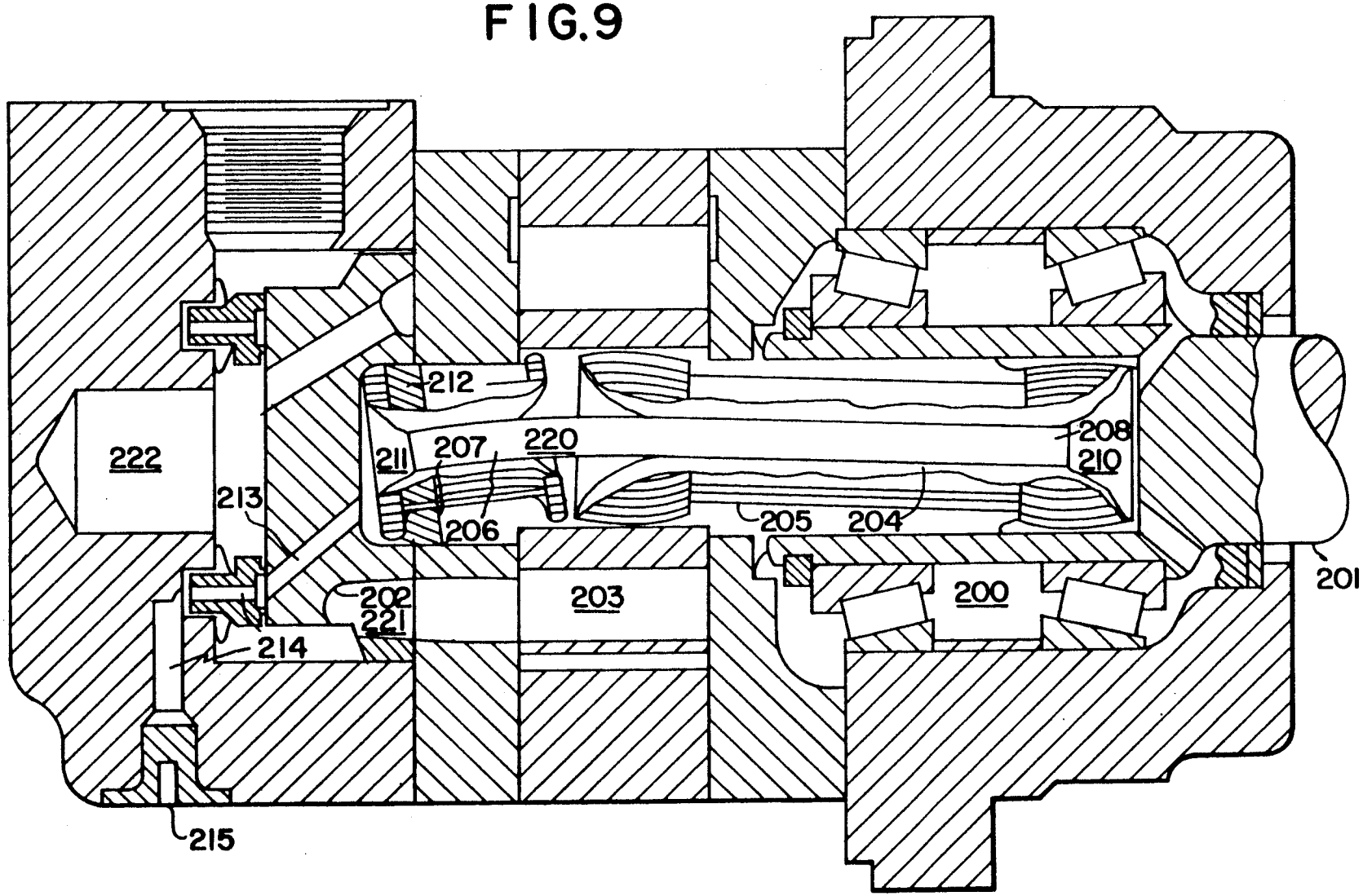

Although the invention has been described in its preferred form with a certain degree of particularity, it is to be realized that numerous changes can be made without deviating from the invention as hereinafter claimed. For example, FIG. 9 discloses the use of the wobble stick hole for drainage incorporated into the device shown in U.S. Pat. No. 4,533,302 issued Aug. 6, 1985. To do this, it is preferred that the central cavity 200 surrounding the drive shaft 201 be isolated from a direct interconnection to the pressure input into the device. Due to this isolation, any fluid which enters into this cavity 200 would be due to the inherent high pressure leakage from the valve 202 and the gerotor structure 203. The device of U.S. Pat. No. 4,533,302 is modified by the incorporation of a hole 204 extending down the length of the wobble stick 205 and a second hole 206 extending down the length of the valve drive shaft 207. A flexible rubber tube 208 extends throughout the length of the hole 204 in the wobble stick 205 and the second hole 206 in the valve drive shaft 207 to unify such holes such that fluid at the head end 210 of the wobble stick 205 is fed to the valve end 211 of the valve shaft 207. A secondary rubber piece 212 adjacent to the rotating valve 202 seals the toothed drive interconnection between the valve shaft 207 and the valve 202 such that any fluid at the valve shaft end 211 is communicated along the hole 213 in the valve 202 through the passageways 214 to interconnect with the drain port 215. The separate seal 212 is utilized to close the toothed drive at this location, a drive that might otherwise bypass sufficient fluid so as to compromise the efficiency of the drain loop. (The preferred embodiment had a smooth non-toothed connection to the valve and as such had a smaller leakage path such that no separate seal was needed.) With close enough tolerance, no separate seal 212 would be needed. In use, the natural leakage from the valve 202 and the gerotor mechanism 203 pressurizes the chamber 200. This fluid then travels from the head end of the wobble stick along the length of the tube 208 and the passages 213, 214 to exit the drain port 215. Note that it is preferred that the ends of the wobble stick 205 and the valve shaft 207 be bell shaped 220 so as to reduce the pressure or forces on the tube 208 at the juncture between the wobble stick 205 and valve shaft 207. The length of the tube 208 is preferably selected such that there is no stress on it when the wobble stick 205 and the valve shaft 207 are oriented in their operative positions as shown in FIG. 9. Note that in this particular embodiment, the drain port 215 could be deleted if the passage 213 was interconnected by a ball check valve to the two fluid connections 221, 222 of the hydraulic device shown in figure 9. Therefore, other modifications are also possible without deviating from the invention as hereinafter claimed.

What is claimed is:

1. An improvement for a device having a fixed housing containing operative pressurized fluid passages, a rotating angular drive wobble stick having an end, and a central cavity, the improvement of means to seal the central cavity from the operative pressurized fluid passages, a drain connection hole, said drain connection hole being in the fixed housing of the device substantially within the area of the fixed housing swept by the longitudinal axis of the rotating angular drive wobble stick adjacent to the end of such angular drive wobble stick, a hole, said hole being in the rotating angular drive wobble stick, said hole fluidically connecting the central cavity to said drain connection hole, and means to drain off fluid from said drain connection hole.

2. The improvement of claim 1 wherein the device has a valve movable in a plane and said hole connecting to said drain connection hole passes through the plane of the movable valve.

3. The improvement of claim 2 characterized by the addition of a seal and said seal extending between said rotating drive stick and the valve.

4. An improvement for a device having a housing with a stationary body with a longitudinal axis and an orbiting valve selectively interconnecting fluid of two ports to expanding and contracting gerotor cells through bi-directional fluid passages through the stationary body of the housing of the device, the orbiting valve directly rotated by an orbiting drive shaft extending through a central opening of the device to connect to the valve, the diameter of the central opening being larger than the diameter of the drive shaft extending therethrough, with the orbiting valve facing a surface of the housing, the improvement of a cavity, said cavity being the surface of the housing facing the orbiting valve, a piston, said piston being in said cavity, and means to bias said piston towards said orbiting valve so as to press said orbiting valve to the central opening of the device, said piston overlapping the longitudinal axis of the housing, a hole, said hole being located substantially on the longitudinal axis of the housing, and means to drain off fluid from said hole.

5. The improvement of claim 4 characterized in that said hole is in said piston.

6. The improvement of claim 4 characterized in that said hole is in said housing.

7. An improvement for a device having a housing with a stationary body with a longitudinal axis and an orbiting valve selectively interconnecting fluid of two ports to expanding and contracting gerotor cells through bi-directional fluid passages through the stationary body of the housing of the device, the orbiting valve directly rotated by an orbiting drive shaft extending through a central opening of the device to connect to the valve, the diameter of the central opening being larger than the diameter of the drive shaft extending therethrough, with the orbiting valve facing a surface of the housing, the improvement of a cavity, said cavity being the surface of the housing facing the orbiting valve, a piston, said piston being in said cavity, and means to bias said piston towards said orbiting valve 50 as to press said orbiting valve to the central opening of the device, said piston overlapping the longitudinal axis of the housing, a hole, said hole being in said piston, said hole being located substantially on the longitudinal axis of the housing, and means to drain of fluid from said hole.

8. An improvement for a device having a housing with a stationary body with a longitudinal axis and an orbiting valve selectively interconnecting fluid of two ports to expanding and contracting gerotor cells through bi-directional passages through the stationary body of the housing of the device, the orbiting valve directly rotated by an orbiting drive shaft extending through a central opening of the device to connect to the valve with a diameter of the central opening being larger than the diameter of the drive shaft extending therethrough, the orbiting valve having a central opening with a minimum extension to the longitudinal axis of such orbiting valve, the improvement of the diameter of the central opening of the device being less than the minimum radius of the central opening minus the offset of the valve such that the central opening of the valve does not interconnect with the central opening of the device throughout the operation of the orbiting valve, a piston, a cavity in the stationary body of the device on the opposite side of the orbiting valve from said central opening, said piston being in said cavity, bias means to bias said piston towards said orbiting valve and said orbiting valve into physical contact with the area surrounding the central opening of the device so as to seal said central opening of the device, said piston being located overlapping the longitudinal axis of the housing, a hole, said hole being in said piston, a drain port, said hole being interconnected to said drain port, and said hole interconnecting to the center drive opening of the orbiting valve so as to interconnect said center opening of the valve to said, drain port.

9. The improvement of claim 8 characterized in that said piston is biased by a spring.

10. The improved device of claim 8 wherein the orbiting drive shaft has a longitudinal length and characterized by the addition of a hole, said hole being along said longitudinal length of said orbiting drive shaft, and said hole through said orbiting drive shaft interconnecting with said center drive opening of the orbiting valve.

11. An improvement for a device having a housing with a stationary body with a longitudinal axis and an orbiting valve selectively interconnecting fluid of two ports to expanding and contracting gerotor cells through bi-directional passages through the stationary body of the housing of the device, the orbiting valve directly rotated by an orbiting drive shaft extending through a central opening of the device to connect to the valve with a diameter of the central opening being larger than the diameter of the drive shaft extending therethrough, the orbiting valve having a central opening with a minimum extension to the longitudinal axis of such orbiting valve, the improvement of the diameter of the central opening of the device being less than the minimum radius of the central opening minus the offset of the valve such that the central opening of the valve does not interconnect with the central opening of the device throughout the operation of the orbiting valve, a piston, a cavity in the stationary body of the device on the opposite side of the orbiting valve from said central opening, said piston being in said cavity, bias means to bias said piston towards said orbiting valve and said orbiting valve into physical contact with the area surrounding the central opening of the device so as to seal said central opening of the device, said piston being located overlapping the longitudinal axis of the housing, a hole, said hole being in said housing, a drain port, said hole being interconnected to said drain port, and said hole interconnecting to the center drive opening of the orbiting valve so as to interconnect said center opening of the valve to said drain port.

12. The improvement of claim 11 characterized in that said piston is biased by a spring.

13. The improved device of claim 11 wherein the orbiting drive shaft has a longitudinal length and characterized by the addition of a hole, said hole being along said longitudinal length of said orbiting drive shaft, and said hole through said orbiting drive shaft interconnecting with said center drive opening of the orbiting valve.

* * * * *